United States Patent [19]

Morgan et al.

[11] 4,070,062

[45] Jan. 24, 1978

[54] METHOD OF AND APPARATUS FOR DISAGGREGATING PARTICULATE MATTER

[75] Inventors: George W. Morgan, Dallas; Joseph E. Zupanick, Richardson, both of Tex.

[73] Assignee: Sun Oil Company Limited, Calgary, Canada

[21] Appl. No.: 740,895

[22] Filed: Nov. 11, 1976

[51] Int. Cl.[2] ..... B63B 35/12

[52] U.S. Cl. ..... 299/10; 299/24; 299/71; 299/89; 114/42

[58] Field of Search ..... 299/10, 18, 71, 86, 299/89, 75, 76, 24–28; 61/1 R, 103; 114/42

[56] References Cited

U.S. PATENT DOCUMENTS

| | | | |
|---|---|---|---|
| 701,979 | 6/1902 | Wisseman | 299/23 X |
| 1,726,891 | 9/1929 | Fisher | 299/23 X |
| 3,050,292 | 8/1962 | Newton et al. | 299/23 X |
| 3,148,917 | 9/1964 | Thompson | 299/25 |
| 3,332,722 | 7/1967 | Gonski | 299/76 X |
| 3,768,428 | 10/1973 | Schirtzinger | 114/42 |

*Primary Examiner*—Ernest R. Purser

*Attorney, Agent, or Firm*—J. Edward Hess; Donald R. Johnson; James H. Phillips

[57] ABSTRACT

A cutting-chipping system comprising an interconnected triaxial array of rotating drums each mounted for independent rotation. Each drum includes a plurality of spaced, outwardly extending teeth to sequentially cut, chip and break particulate mass such as coal or ice engaged by the system. The drums are oriented with no axis of drum rotation parallel to another and in a configuration wherein the direction of cutter travel from one drum is oblique to that of a second drum. In this manner, particulate matter engaged by the system is initially cut and chipped by a first drum to form a series of protuberances and/or weakened sections which, when struck at an oblique angle by a second drum, will chip and break away. The teeth may be comprised of picks, chisels or combinations thereof constructed and adapted for bidirectional rotation. The system may be adapted for applications upon land vehicles, water crafts, floating platforms, and the like. Variation in rotation velocity of the separate drums and/or opposing rotational directions thereof may then facilitate positional control of the system as well as depth and speed of cutting as necessitated by the particular application.

13 Claims, 5 Drawing Figures

METHOD OF AND APPARATUS FOR DISAGGREGATING PARTICULATE MATTER

BACKGROUND OF THE INVENTION

The invention relates to a method of and apparatus for disaggregating particulate matter, and, more particularly, to a cutting-chipping mass removal system including an interconnected array of rotatable drums.

In the petroleum exploration and production industry it is often necessary to station men and equipment in relatively hostile environmental regions. In recent years the emphasis on oil production from the far north has necessitated development of new techniques for encountering formations of ice and the movements thereof which threaten the stability and/or position of equipment situated therearound.

In the Artic, large offshore regions are often covered by thick layers of ice. The recovery of minerals beneath these frozen waters requires the penetration of sections of ice for equipment installation. Similarly, once drilling platforms are installed and secured above a bottom mounted installation, it is important to keep the adjacent ice packs away from the moored platform structure. It is particularly necessary to have the capability of engaging an ice floe moving against the around such platforms so that the platform remains relatively stationary in conjunction with the borehole depending therefrom. The enormous mass of the moving ice in such regions has created a formidable problem fostering the need for effective means for expeditiously breaking up imposing ice layers.

Prior art ice removal systems have sought to provide cutters and chippers generally upon vertical or horizontal rotating drums, often operated in pairs, with axes of rotation being generally parallel. In Artic regions of platform operation, such cutters are often mounted on the bow of tugs which may circle drilling and production platforms to engage and cut the undesirable ice. This design and approach commonly facilitates a cutting-grinding action in the ice pack by "eating" away at the face of the abutting portions. Although effective in breaking up solidified, brittle masses, the basic cutting-grinding technique is antiquated. For example, a single rotating cutter will generally produce parallel spaced serrations with ridges therebetween in the ice. The serrations must be spaced close enough together to allow a second rotating cutter and/or blade, providing equally parallel serrations, to break up the ice ridges left from the first cutter. Because the ice is being struck, chipped and grooved in parallelism, the structural vulnerability of the ice ridges between serrations due to "shear" weakness is not addressed. Once a ridge is produced between two serrations in the face of a sheet of ice, it would take considerably less force to break and shatter the ridge by striking it at an oblique angle and thereby fracturing it in shear than it would to cut the ridge as a normal serration. With the "shear" approach, the ridges could actually be spaced further apart than is conventionally provided with normal cutters. In the same vein, it may be seen that it would take fewer teeth upon a drum to impart oblique angle blows to serrated ice ridges to accomplish the same degree of ice removal indicative of conventional parallel chipper systems.

It would be an advantage therefore, to overcome the disadvantages of prior art ice cutting and removal systems by providing means for effectively cutting serrations in masses of ice and the like and subsequently striking the ridges therebetween through oblique angles to break the ridges away. The method and apparatus of the present invention are provided for just such a purpose and for application involving other particulate matter such as coal. A triaxial array of cutter drums are provided, some of which are adapted to engage layers of ice and cut serrations therein at the same time other cutters engage the serrations which have just been cut and strike them at an oblique angle. The encountered ice, coal, or the like, may then be systematically cut, shattered and removed, rather than conventionally "chewed" upon. In this manner, less energy may be required to break up imposing ice layers or to cut through layers of coal, as the case may be. Similarly, mass removal may be effected in a more sophisticated and efficient fashion when particulate matter is involved.

SUMMARY OF THE INVENTION

The invention relates to a method of and apparatus for chipping and breaking up formations of particulate mass such as ice, including an array of rotatable cutting drums being oriented with the axis of rotation of one drum forming an oblique angle with the axis of rotation of a second drum. Rotation of the drums produces improved mass removal effectiveness by first cutting and chipping serrations to form ridges therebetween which shatter when struck at an oblique angle. More particularly, one aspect of the invention includes first and second drums mounted for rotation about axes oriented at an oblique angle one to the other. Each drum includes a plurality of teeth protruding outwardly from the outside surface of each drum to engage, serrate and/or chip the particulate matter engaged thereby. The circular paths formed by the tops of the teeth, when the drums are rotated, therein form an oblique angle to one another. Means are provided for rotating each drum in said oblique paths for therein cutting serrations and breaking up the ridges therebetween.

In another aspect of the invention a system is provided for chipping particulate matter including an array of three, independently rotatable drums mounted in a triangular configuration. Each drum is comprised of a generally elliptical, longitudinal, cross-sectional shape, wherein teeth protruding outwardly of adjacent drums do not overlap. The teeth may be provided in a "pick" like configuration facilitating both forward and backward cutting-chipping rotation. The triangular array may also be provided on the end of a boom adapted for positioning outboard a supporting platform for engaging and removing particulate matter therearound. The removal and/or disaggregation of particulate matter such as ice, or coal is thereby readily facilitated.

In yet another aspect of the invention a method for chipping and breaking up particulate matter is provided, including the step of serrating the matter with a plurality of generally parallel cuts to form ridges therebetween. The ridges are then struck at an oblique angle, with a plurality of blows to break and shatter the engaged portions thereof. More particularly, one aspect of the invention includes the provision of first and second bodies of revolution having teeth extending therefrom adapted for cutting and chipping matter engaged thereby. The bodies are rotated with the teeth forming circular paths therearound, which circular paths of separate bodies of revolution are at oblique angles one to the other. In this manner, a method is provided for removing particulate matter such as ice or coal with maximized effectiveness.

BRIEF DESCRIPTION OF THE DRAWINGS

For a more complete understanding of the present invention, and, for further objects and advantages thereof, reference may now be had to the following description taken in conjunction with the accompanying drawings, in which.

DETAILED DESCRIPTION

Figure 1:
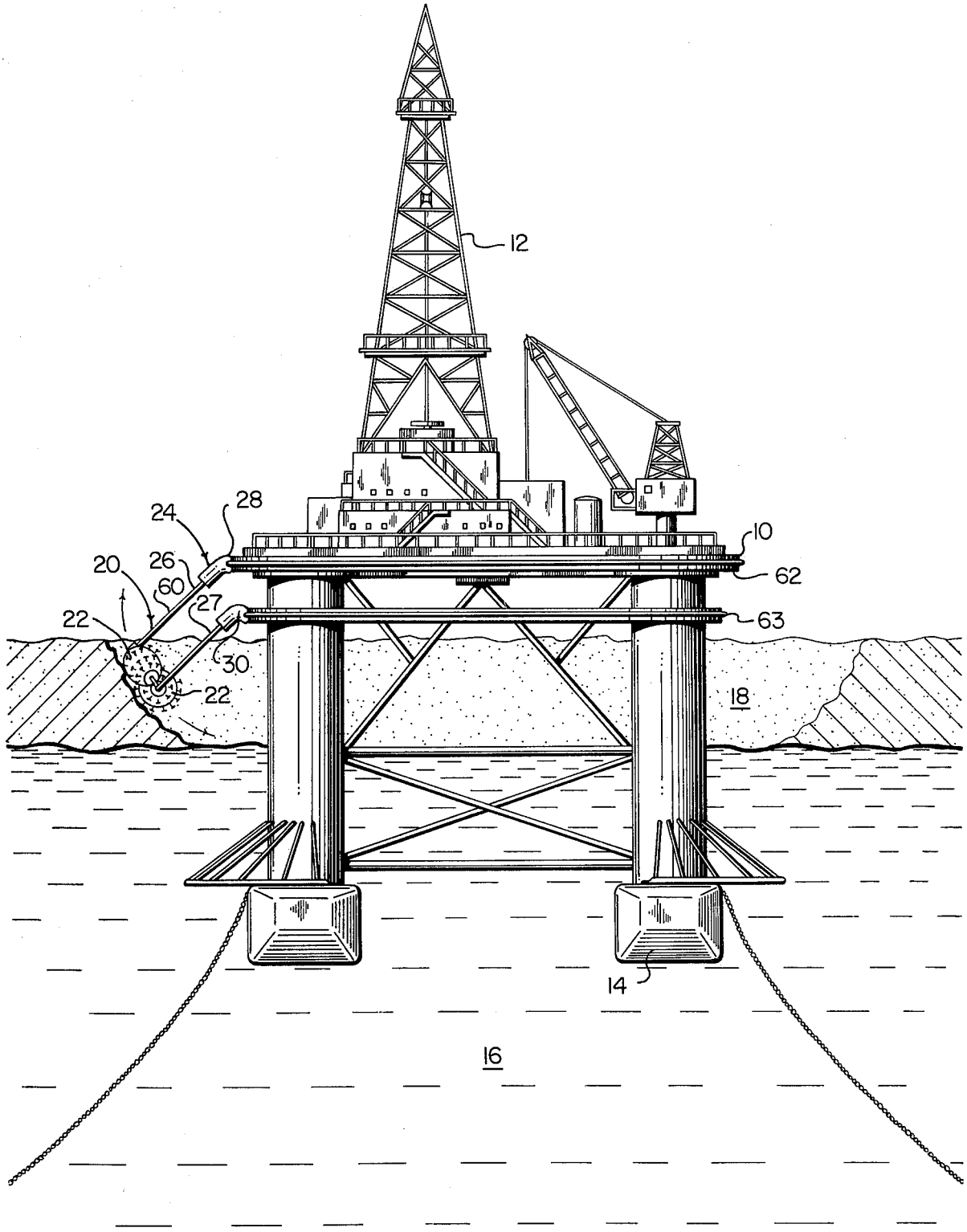
FIG. 1 is a side elevational view of a typical semi-submersible drilling platform, utilizing one embodiment of a method of and apparatus for chipping and removing particulate matter from therearound, in accordance with the principles of the present invention.

Referring first to FIG. 1, there is shown a side elevational view of a semi-submersible drilling platform 10 with one embodiment of a system attached thereto for chipping and removing particulate matter, such as ice. The platform 10, as shown for purposes of illustration, includes a derrick structure 12 upstanding from a flotation assemblage 14 partially submersed in a body of water 16 supporting an ice layer 18 thereabove. Such ice packs as illustrated adjacent to the platform 10, typify the environmental condition often encountered in regions of Artic petroleum exploration or production. The ice 18 may be seen to present a tangible threat to the stability of the platform 10, once in abutting engagement therewith and as the ice shifts laterally to exhibit movement relative to the moored structure. An ice removal system 20 is thus shown to be provided upon the platform 10 extending outwardly therefrom for breaking up imposing ice layers and the like. The effectiveness of system 20 is preferably maximized by mooring the platform 10 along its submerged base, as shown herein.

The ice removal system 20 may be seen to include a plurality of revolving drums 22, rotatably mounted on the end of a boom structure 24 extending outboard the platform 10. The boom 24, herein diagrammatically represented for purposes of clarity is adapted for pivotal movement about the platform for engaging and removing ice adjacent thereto. The boom 24, as shown, includes a pair of telescoping struts 26 and 27 attached to the platform 10 at separated pivotal connections 28 and 30, preferably through tilting hydraulic cylinders (not shown). Operation of the hydraulic cylinders, and other conventional mechanical control devices necessarily incorporated for implementation of the present invention, tilt the struts 26 and 27 in an arcuate path about the connections 28 and 30 effecting ice engagement and disaggregation. The cylinders may be actuated by conventional control means on the platform 10.

Figure 2:
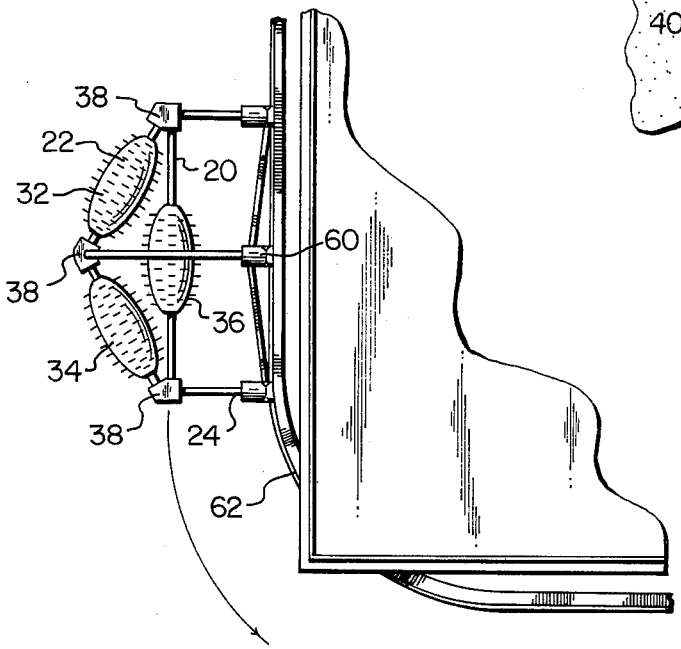
FIG. 2 is a fragmentary, top plan view of the drilling platform of FIG. 1, illustrating in more detail the triangular array of rotating drums comprising the apparatus for chipping and removing particulate matter from therearound.

Referring now to FIG. 2, there is shown more clearly the construction of the system 20 and one embodiment of a structural configuration specifically adapted for applications upon flotation structures such as the platform 10. The drums 22 are preferably provided in a triaxial array, wherein the axis of rotation of one is not parallel to that of another. The triangular configuration shown herein is comprised of angulated frontal drums 32 and 34 adjacent transversely connecting rear drum 36 for systematically providing primary and secondary ice engagement functions. The rotation of each separate drum is preferably provided through drive means powered from the platform 10 through the boom 24. Conventional hydraulic drives have been shown to be suitable for facilitating independent rotation of each drum as is preferable for maximized control and effectiveness. In such a construction, hydraulic motors (not shown), may be provided in the area of the drum journals 38, therein requiring only the presence of fluid pressure lines (not shown) to the various motors for rotation of the respective drum 22.

Figure 5:
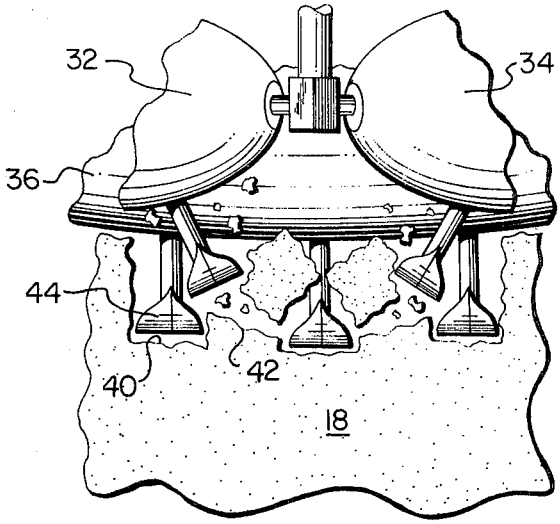
FIG. 5 is an enlarged, fragmentary, perspective view of the pattern of serrations and angle of engagement therewith produced by the rotating drums of FIG. 1 in accordance with the principles of the present invention.

Referring now to FIG. 5, there is shown in more detail the pattern of serrations produced by the rotating drums 22 in accordance with the principles of the present invention. The triangular configuration of the array of drums may be seen to incorporate a primary-secondary, cutting-shipping patterns in the ice 18 which maximizes the destruction and removal thereof. As the boom 24 is moved about the platform 10, rear drum 36 is permitted to initiate the cutting of the ice 18 with longitudinal serrations 40 formed therein and having upstanding ridges 42 therebetween. The frontal drums 32 and 34 are then permitted to engage the serrations 40 and ridges 42 in the ice. Because of the angle of incidence of the teeth engagement by the secondary drums, the ridges 42 are struck and broken through structural weakness known as "shear". Conventionally, the ridges 42 are chipped away in the same manner that the original serrations 40 were formed. As such, the width of ridges 42 must generally be equivalent to that of the original serrations 40. With the fracture in "shear" approach of the present invention, the ridges 42 may be wider than the original serrations 40; and in this manner the teeth 44 of the second drum 22 may effectively disaggregate more ice than conventionally possible.

The drum array concept of the present invention incorporates at least two ice-chipping, bodies of revolution, oriented at an oblique angle one to the other. An angle between 15° and 45° as formed between frontal drums 32 or 34 and rear drum 36 has been shown to be effective, although any suitable oblique angle would be equally functional. An angle of 30° is illustrated in the drawings, as that angle provides relative force balancing between primary and secondary drums 22, when they are rotating at the same speed and in opposite directions. In the same manner, forces inducing desirable drum array travel may be imparted by imposing a predetermined rotational speed differential between drums. The relative interaction between the ice 18 and drums 22 will then cause the drum array to advance or retract as desired without imparting excessive loads to the structural elements of the boom 24. Counter rotating drums similarly impart motional stability to the boom 24 and drum array in a manner heretofore considered impractical in such disaggregation applications.

Figure 3:
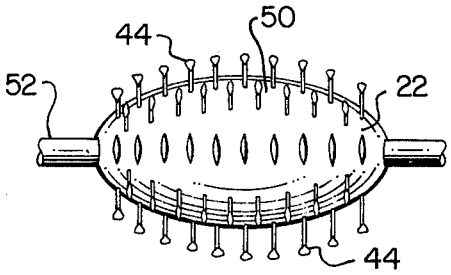
FIG. 3 is an enlarged, fragmentary, top plan view of one of the rotating drums of FIG. 1, illustrating in more detail the construction thereof.

Referring now to FIG. 3, there is shown the structural configuration of a single body of revolution adopted for chipping particulate matter in accordance with the principles of the present invention. Drum 22, as herein illustrated, includes a generally longitudinally elliptical body 50 secured to a shaft 52. Teeth 44, extending outwardly from the body 50, are adapted for both cutting, chipping and breaking particulate matter as the drum 22 is rotated in engagement therewith. The elliptical configuration facilitates relative close positioning of adjacent drums without overlapping of teeth. Although synchronized teeth overlap would be possible in applications of constant speed counter rotation, the cutter control aspect provided by selectable speed differentials may be seen to be preferable. This control aspect facilitates applications in all forms of particulate matter such as ice, coal, oil shale, and the like, where the matter is relatively brittle and susceptible to stress failure in a shear mode.

Figure 4:
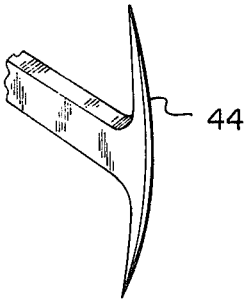
FIG. 4 is an enlarged, fragmentary, perspective view of one embodiment of a cutting-chipping tooth of the type employed upon the rotating drum of FIG. 1.

The particular tooth configuration illustrated in FIG. 4 is provided in a "pick" like configuration. This shape facilitates applications which require bi-directional drum rotation, because the same chipping-cutting effect is possible in either direction of tooth travel. Although now shown specifically herein, alternative tooth configurations are possible and may be preferable in certain applications. For example, blunted or wedge shaped teeth 34 may prove more effective in less brittle coal or oil shale formations.

In operation, the triangular array of drums 22 is positioned outboard the platform 10, or equivalent supporting structure as utilized in other applications. The drums 22 are disposed in engagement with the particulate matter and rotated with the primary drums revolving in the opposite directions from the secondary drums. Fore and aft movement of the drum array is provided by speed differential between the primary and secondary drums, while transverse or lateral movement is provided by speed differential between the separate frontal drums 32 and 34. Lateral movement of the drum array is facilitated by transverse angulation of the boom 24 and movement of the particular supporting carriage. As shown in FIGS. 1 and 2, a boom carriage 60 is provided for travel upon an upper track 62 and lower track 63 mounted around the periphery of the platform 10. The carriage 60 is moved upon the tracks 62 and 63 for engaging the ice at any point about the structure. The upper track 62 may be seen to extend outwardly from the platform 10 a greater distance than lower track 63. This track diameter differential improves the moment arm characteristics for disaggregation operations near the base of the platform 10. It may be seen also that other than the provision of such tracks 62 and 63 only relatively moderate platform modifications are necessary to implement the present invention. Moreover, a plurality of systems 20 may be utilized upon a single platform.

It is thus believed that the operation and construction of the method of and apparatus for disaggregating particulate matter will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. A system for chipping and disaggregating particulate matter comprising:

first and second drums mounted in an array for rotation about axes oriented at an oblique angle one to the other;

a plurality of teeth protruding outwardly from the outside surface of each drum to engage, serrate and break the particulate matter, the circular paths formed by the tops of the teeth, when the drums are rotated, being at an oblique angle to one another;

means for rotating said first drum in engagement with the particulate matter to form serrations therein and ridges therebetween; and means for rotating said second drum and engaging the ridges formed in the particulate matter at an oblique angle for chipping and breaking said ridges to effect the removal thereof.

2. A system for disaggregating particulate matter as set forth in claim 1 wherein said drum array includes three drums mounted in a triangular configuration.

3. A system for disaggregating particulate matter as set forth in claim 2 wherein said drums are each independently rotatable with respect to the other.

4. A system for disaggregating particulate matter as set forth in claim 1 wherein said drums are each comprised of a generally elliptical longitudinal configuration.

5. A system for disaggregating particulate matter as set forth in claim 1 wherein said teeth protruding from said drums are provided in a pick configuration.

6. A system for disaggregating particulate matter as set forth in claim 1 wherein said drum array is provided on the end of a boom adapted for being selectively positionable to engage and disaggregate said matter.

7. A system for disaggregating particulate matter as set forth in claim 1 wherein said particulate matter is ice.

8. A system for disaggregating ice as set forth in claim 7 wherein said drum array is provided on the end of a boom adapted for positioning outboard a supporting platform adjacent the ice and engaging and removing the ice therearound.

9. A system for disaggregating particulate matter as set forth in claim 1, wherein said particulate matter is coal.

10. A method of disaggregating particulate matter comprising:

serrating the particulate matter with a plurality of generally parallel cuts to form ridges therebetween by: providing a first body of revolution having teeth extending therefrom adapted for cutting and chipping matter engaged thereby; and rotating said first body of revolution with said teeth forming circular paths therearound, a portion of which engages the particulate matter and forms serrations therein; and striking the ridges at an oblique angle with a plurality of blows to break and shatter the engaged portion thereof by:

providing a second body of revolution having teeth extending therefrom adapted for cutting and chipping matter engaged thereby; and rotating said second body of revolution with said teeth forming circular paths therearound, which paths lie at an oblique angle to said circular paths of said first body of revolution.

11. A method of disaggregating particulate matter as set forth in claim 10 wherein the relative angle at which said circular paths of teeth intersect one another is between 15° and 45°.

12. A method of disaggregating particulate matter as set forth in claim 11 wherein the relative angle at which said circular paths of teeth intersect on another is 30°.

13. A method of disaggregating particulate matter as set forth in claim 10 and including the step of providing a third body of revolution extending therefrom, said third body being provided adjacent said first and second bodies forming a triangular array.

* * * * *